US009849365B2

(12) United States Patent
Faucette

(10) Patent No.: US 9,849,365 B2
(45) **Date of Patent: *Dec. 26, 2017**

(54) FOOT MOUNTABLE GOLFING AID

(71) Applicant: Fighting Golf, LLC, Ashburn, VA (US)

(72) Inventor: Tiffany Faucette, Ashburn, VA (US)

(73) Assignee: FIGHTING GOLF, LLC, Ashburn, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/295,224

(22) Filed: Oct. 17, 2016

(65) Prior Publication Data

US 2017/0028287 A1 Feb. 2, 2017

Related U.S. Application Data

(63) Continuation-in-part of application No. 14/813,288, filed on Jul. 30, 2015, now Pat. No. 9,468,832.

(51) Int. Cl.
*A63B 69/36* (2006.01)
*A63B 71/06* (2006.01)

(52) U.S. Cl.
CPC ..... *A63B 69/3667* (2013.01); *A63B 69/3608* (2013.01); *A63B 69/3676* (2013.01); *A63B 2071/0694* (2013.01); *A63B 2207/02* (2013.01); *A63B 2209/08* (2013.01); *A63B 2209/10* (2013.01); *A63B 2210/50* (2013.01); *A63B 2220/18* (2013.01); *A63B 2225/09* (2013.01); *A63B 2225/093* (2013.01); *A63B 2225/50* (2013.01)

(58) Field of Classification Search
USPC ..... 473/217, 218, 257, 270, 272, 273
See application file for complete search history.

(56) References Cited

U.S. PATENT DOCUMENTS 3,175,827 A * 3/1965 Livingood ..... A63B 69/3608 33/262
3,343,842 A * 9/1967 Woerner ..... A63B 69/3667 473/217
3,708,174 A * 1/1973 Kamarauskas .... A63B 69/3667 273/DIG. 21
5,016,885 A * 5/1991 Quigley ..... A63B 69/0059 434/252

(Continued)

*Primary Examiner* — Nini Legesse
(74) *Attorney, Agent, or Firm* — Buchanan Ingersoll & Rooney PC

(57) ABSTRACT

A foot mountable golfing aid is operable to provide a reference path for a swing of a golfer, indicate a swing path, indicate a proper width of stance of a golfer, and/or aid in alignment of a golfer's body in relation to a target when the foot mountable golfing aid is mounted on the foot of a golfer. The foot mountable golfing aid includes a foot attachment component that is configured to be attached to a foot of a golfer, and a vertically adjustable reference component. The vertically adjustable reference component is supported by the foot attachment component. The vertically adjustable reference component is operable to provide a reference path for a swing of a golfer, indicate a swing path, indicate a proper width of stance of a golfer, and/or aid in alignment of a body of a golfer in relation to a target when the foot mountable golfing aid is attached to the foot of a golfer.

20 Claims, 8 Drawing Sheets

(56) References Cited

U.S. PATENT DOCUMENTS

| | | | | |
|---|---|---|---|---|
| 5,599,240 | A | 2/1997 | Feldmeier | |
| 5,947,832 | A * | 9/1999 | Gagne | A63B 69/3667 473/217 |
| 7,156,747 | B2 * | 1/2007 | Perry | A63B 69/3667 473/217 |
| 7,261,653 | B2 * | 8/2007 | Thornburg | A63B 69/3667 473/266 |
| 7,431,661 | B1 | 10/2008 | Cailey | |
| 7,722,473 | B1 * | 5/2010 | Shah | A63B 69/3608 473/218 |
| 7,758,436 | B2 * | 7/2010 | Reynolds | A63B 69/0057 473/207 |
| 7,758,438 | B1 * | 7/2010 | Colomberti | A63B 69/3608 473/217 |
| 9,468,832 | B1 * | 10/2016 | Faucette | A63B 69/3667 |
| 2009/0118027 | A1 | 5/2009 | Safstrom | |

* cited by examiner

FOOT MOUNTABLE GOLFING AID

This application is a Continuation-In-Part of application Ser. No. 14/813,288, filed Jul. 30, 2015, which is incorporated herein by reference in its entirety to provide continuity of disclosure.

FIELD OF THE INVENTION

This invention pertains to golf aids, and may find particular use in golf aids that are attachable to the foot of a golfer.

BACKGROUND

Golf is a complex sport that involves a summation of human movement and forces prior to, during and after ball contact. Golf aids can help a golfer improve their game. Some devices vary tremendously, while others have only minor variations that separate them; therefore, even subtle differences can make a large difference in a complex series of alignments and movements involved in every golf stroke. Further, many prior golf aids are placed on the ground, and picked up and moved, each time a golfer wants to change location. Other golfing aids can damage putting greens and are burdensome to walk with. Thus, there is a need for a foot mountable golfing aid that is not burdensome to walk with and does not damage putting greens.

SUMMARY

Disclosed herein is a foot mountable golfing aid that is operable to provide a reference path for a swing of a golfer, indicate a swing path, indicate a proper width of stance of a golfer, and/or aid in alignment of a body of a golfer in relation to a target when the foot mountable golfing aid is mounted on the foot of a golfer. The foot mountable golfing aid includes a foot attachment component that is configured to be attached to a foot of a golfer, and a vertically adjustable reference component. The vertically adjustable reference component is supported by the foot attachment component. The vertically adjustable reference component is operable to provide a reference path for a swing of a golfer, indicate a swing path, indicate a proper width of stance of a golfer, and/or aid in alignment of a body of a golfer in relation to a target when the foot mountable golfing aid is attached to the foot of a golfer.

Also disclosed herein is a shin mountable golfing aid operable to provide a reference path for a swing of a golfer, indicate a swing path, indicate a proper width of stance of a golfer, and/or aid in alignment of a body of the golfer in relation to a target when mounted on the shin of a golfer. The shin mountable golfing aid including a shin attachment component configured to attach to a shin of a golfer, and a vertically and/or horizontally adjustable reference component that is supported by the shin attachment component. The vertically and/or horizontally adjustable reference component is operable to provide a reference path for a swing of a golfer, indicate a swing path, indicate a proper width of stance of a golfer, and/or aid in alignment of a body of the golfer in relation to a target when the shin mountable golfing aid is attached to the shin of a golfer.

Further disclosed herein is a golf aid shoe operable to provide a reference path for a swing of a golfer, indicate a swing path, indicate a proper width of stance of a golfer, and/or aid in alignment of a body of the golfer in relation to a target when worn by a golfer. The golf aid shoe including a shoe configured to receive a foot of a golfer, and a vertically adjustable reference component that is supported by the shoe. The vertically adjustable reference component operable to provide a reference path for a swing of a golfer, indicate a swing path, indicate a proper width of stance of a golfer, and/or aid in alignment of a body of the golfer in relation to a target when the golf aid shoe is worn by a golfer.

BRIEF DESCRIPTION OF THE DRAWING FIGURES

DETAILED DESCRIPTION

Figure 1A:
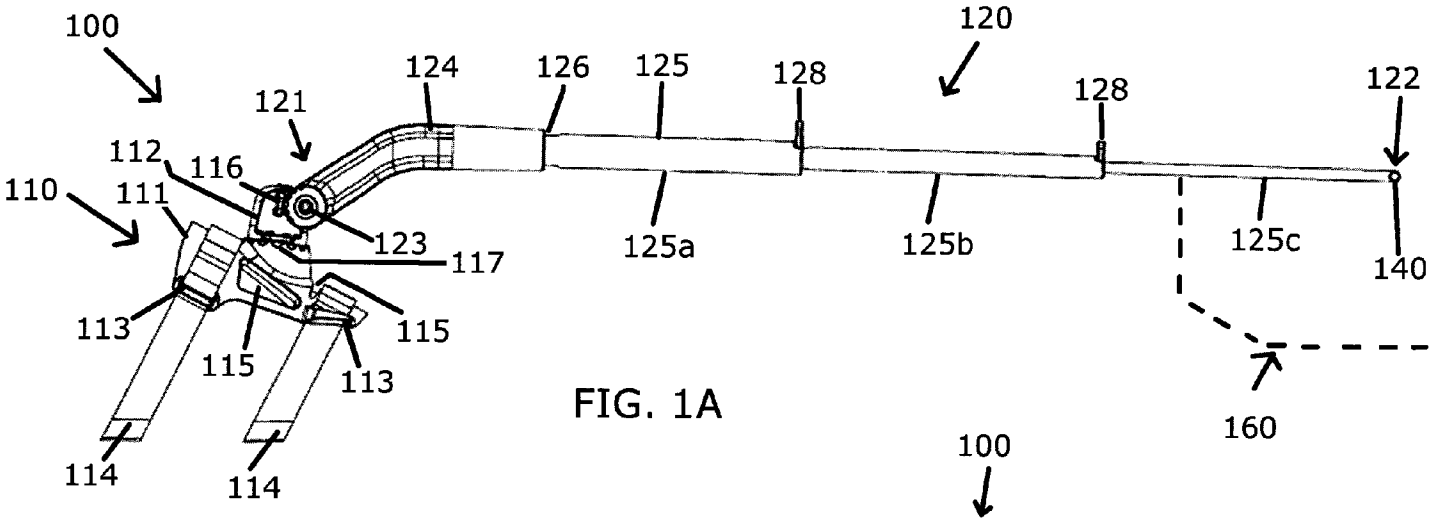
FIG. 1A illustrates an embodiment of a foot mountable golfing aid according to an embodiment as disclosed herein.

In the following detailed description, numerous specific embodiments are set forth in order to provide a thorough understanding of the golfing aid apparatus and methods disclosed herein. However, as will be apparent to those skilled in the art, the present embodiments may be practiced without these specific details or by using alternate elements or processes. In other instances, well-known processes, procedures, and/or components have not been described in detail so as not to unnecessarily obscure aspects of embodiments disclosed herein. As used herein, the terms "swing" and "stroke" may refer to a putting stroke, a partial swing, chipping stroke, or a full swing. As used herein, the terms "vertical" and "vertically" are in relation to a direction perpendicular to ground, and the terms "horizontal" and "horizontally" are in relation to a direction parallel to the ground. As used herein, the terms "shoe" and "foot" both refer to a shoe or a foot of a golfer or user of embodiments of the apparatus as disclosed herein. As used herein, "reference path" may refer to a swing path, a swing plane, and/or a swing alignment.

As indicated, present embodiments provide a foot mountable golfing aid ("golfing aid") that is operable to provide a reference path for a swing of a golfer, indicate a swing path, indicate a proper width of stance of a golfer, and/or aid in alignment of a body of a golfer in relation to a target when the foot mountable golfing aid is mounted on the foot of a golfer. Additionally, the golfing aid can indicate the height of the club through the impact area. The foot mountable golfing aid includes a foot attachment component that can be attached to a foot of a golfer, and a reference component that provides a reference for a swing or putting stroke of a golfer. Preferably, the reference component is a vertically adjustable reference component. The vertically adjustable reference component is supported by the foot attachment component. The vertically adjustable reference component is vertically adjustable and operable to indicate a swing plane and provide a reference path for a swing of a golfer, indicate a proper width of stance of a golfer, and/or aid in alignment of a body of a golfer in relation to a target when the foot mountable golfing aid is attached to the foot of a golfer and the vertically adjustable reference component is adjusted to a desired height. Depending on the height of the golfer as well as the type of swing the golfer intends to perform (i.e. full swing or putting stroke) the desired vertical height of the vertically adjustable reference component may vary.

The foot mountable golfing aid can be worn on either foot of a golfer, preferably a golfer wears the foot mountable golfing aid on each foot during practice of a golf swing. Wearing the golfing aid on the front foot can help train certain swing elements that are different from swing elements that may be trained when a golfer wears the golfing aid on the back foot.

The golfing aid can include a vertically adjustable reference component used to provide a reference path for a putting stroke, chipping stroke, or full swing of a golfer that can be used to improve the putting stroke, chipping stroke, or a full swing of the golfer. During putting, the golfing aid can improve alignment of the club face (i.e. provide a reference perpendicular to a target line for the golfer) as well as help position the feet of a golfer with respect to a target line. The golfing aid can also help a golfer identify their shoulder location, hip location, knee location, the putter club head height during a stroke, and ball position. For different swings the vertically adjustable reference component can be adjusted to different heights to accommodate different lie angles and lengths of the different golf clubs in the set and to adjust to the posture and stature of a golfer.

During a full swing, the golfing aid can help improve a golfer's swing path, alignment, shoulder plane, weight transfer, stance, ball position, and hand path. For example, the golf aid can include a vertically adjustable reference component which is positioned between a golfer's feet and a golf ball wherein the vertically adjustable reference component helps a golfer identify the path a club should travel through impact of the golf ball. In an embodiment, wearing the golfing aid on the back foot helps a golfer work on the swing path of the take away, while wearing the golfing aid on the front foot helps work on swing path on the follow through.

The golfing aid can improve alignment, as the club face can be easily seen while wearing the golfing aid, and in an embodiment it is easy to see if the club face is perpendicular to the cross-bar of the golfing aid. The golfing aid can help a golfer ensure that their feet are parallel. Additionally, the golfing aid can help a golfer ensure that their toe line is parallel to their intended target line. Further, the golf aid can help a golfer identify whether their shoulders, hips, and/or knees are square. In an embodiment, the golfing aid helps a golfer learn how to turn their torso.

In an embodiment, the reference component of the golfing aid can include a boom or rod that extends outwardly from the foot of a golfer, and a cross-bar at the end of the boom which can be perpendicular or substantially perpendicular to the boom. Preferably, the cross-bar is straight however in an alternate embodiment the cross-bar can include one or more bends, such as at either of the ends thereof. The cross-bar or a portion of the cross-bar preferably runs parallel to a target line of the golfer. Thus, when the golfing aid is worn on the front foot, the club head should travel under a portion of cross-bar, when the cross-bar is set to parallel (i.e. horizontal) to the ground, from the impact of the golf ball until the club head reaches the front foot. In order for this to occur a proper weight shift should also occur.

The golf aid can also help a golfer obtain a proper width of stance. For example, in an embodiment, the cross-bar may be moved from a horizontal position to a vertical position. When in the vertical position, the shin bones of a golfer should be in line with the vertical portion of the cross-bar. This ensures proper width of stance based on bone structure so that a golfer can make a backswing without sway.

The cross-bar of the reference component can also include markings thereon, such that a golfer can consistently position the ball with respect to their body. Additionally, to ensure a proper hand path, a golfer must take the club back wherein their hands stay between a portion of the cross-bar that is parallel to the target line and their legs. The hands should not go outside of the cross-bar. On the way down during a swing, the hands should return from inside the cross-bar to ensure a good path. If the hands come from outside the cross-bar on the downswing, a golfer will be coming over the top of the swing plane and the golfer will have a path that does not promote a straight shot.

FIGS. 1A-1D illustrate a preferred embodiment of a foot mountable golfing aid 100 according to an embodiment as disclosed herein. As shown in FIGS. 1A-1D, the foot mountable golfing aid 100 includes a foot attachment component 110 that is configured to be attached to a foot of a golfer during use, and a vertically adjustable reference component 120 that is supported by the foot attachment component 110. The vertically adjustable reference component 120 is operable to provide a reference path for a swing of a golfer, indicate a swing path, indicate a proper width of stance of a golfer, and/or aid in alignment of a golfer's body in relation to a target when the foot mountable golfing aid 100 is attached to the foot of a golfer. The vertically adjustable reference component 120 can include a first end portion 121 pivotally attached to the foot attachment component 110 at a pivot 123. The vertically adjustable reference component 120 can also include a second end portion 122 that is outward of the first end portion 121 such that the second end portion 122 may be vertically adjusted by rotating the vertically adjustable reference component 120 around the first end portion 121. The second end portion 122 preferably provides a reference path for a swing of a golfer when the foot mountable golfing aid is attached to the foot of a golfer.

In an embodiment, the second end portion 122 can include one or more lasers 140 (see FIG. 1A) that provide a reference path for a swing of a golfer wherein the one or more lasers 140 can be directed towards the ground and/or outwardly. For example, in an embodiment, the one or more lasers 140 can be configured to illustrate a linear reference path on the ground wherein the reference path can be configured to be parallel to a desired target line of a stroke of a golfer. In a further embodiment, the one or more lasers 140 can be located at any position on the foot mountable golfing aid 100.

In an embodiment, the vertically adjustable reference component 120 can include a base 124 at the first end portion 121 of the vertically adjustable reference component 120. The base 124 has an opening 126 in which a boom 125 that extends outwardly from the base 124 is located. Preferably, the opening 126 is a through opening that extends completely through a portion of the base 124. The opening 126 preferably includes the boom 125 therein such that the boom 125 is movable within the opening 126 of the base 124 wherein the boom 125 may be movable among a retracted position, intermediate positions, and an extended position. In an embodiment, the boom 125 may be friction fit in the base 124 such that the position of the boom 125 may be finely adjusted within the base 124. In a preferred embodiment, the opening 126 of the base can include at least one groove (not shown) wherein at least one rail (not shown) on the boom 125 is fitted in the groove such that the boom 125 is aligned in the base 124, or in an alternate embodiment the base can include at least one rail that is fitted in a groove of the boom.

In an alternate embodiment, the vertically adjustable reference component 120 can include a boom 125 having a first end portion pivotally attached to the foot attachment component 110 and a second end portion outward of the first end portion. The second end portion may be vertically adjusted by rotating the vertically adjustable reference component around the first end, wherein the second end portion provides the reference path for a swing of a golfer when the foot mountable golfing aid is attached to the foot of a golfer. In an alternative embodiment, the vertically adjustable reference component can include a boom 125 that can have a first portion that is vertical or substantially vertical to the foot attachment component 110 and a second portion that extends horizontally from the first portion. The first section of the boom 125 in this embodiment may be extendable such that the vertical height of the boom may be increased or decreased. Likewise, the second section of the boom can be extendable such that the horizontal length of the boom may be increased or decreased.

Referring back to FIGS. 1A-1D, the boom 125 can include a cross-bar 129 at the end thereof wherein the cross-bar 129 is configured to provide a reference path for a swing of a golfer when the foot mountable golfing aid is attached to the foot of a golfer. Preferably the cross-bar 129 extends perpendicular to the length of the boom 125. In an embodiment, the cross-bar 129 may be integral with the boom 125, in an alternative embodiment, the cross-bar 129 may be attached to the end of the boom 125 with screws or the like. For example, the cross-bar 129 may include two pieces that each screw into the boom 125, such that the cross-bar 129 may be removed. In a different embodiment, the cross-bar 129 can be a single piece that screws into the end of the boom 125. In an embodiment, the cross-bar 129 can include a level 141, such as a bubble level or digital level, wherein the level may indicate the slope of the ground in which a golfer is standing. The level 141 can indicate to a golfer when the golfer needs to adjust ball position or their stance such as when a golf ball has an uneven lie in the fair way. Preferably the level 141 is at the center of the cross-bar 129 (see FIG. 1B), however the level 141 can be included in any position on the golfing aid 100. In an embodiment, the level 141 and/or the laser 140, as well as other electronic functions of the golfing aid 100, can communicate with a golfer's cell phone via a cell phone application and blue tooth or the like. In this embodiment, the golf aid 100 includes the necessary electrical components such as a logic controller, power source, and the like.

In an embodiment, the foot attachment component 110 can include a contoured plate 111 that is configured to fit against an upper portion of a foot or shoe of a golfer when attached to the foot of a golfer. Preferably, the contoured plate 111 is contoured such that the foot attachment component 110 can be attached to the left or right foot of golfer, however in a further embodiment, the contoured plate 111 can be contoured for a right foot of a golfer or a left foot of a golfer. The contoured plate 111 preferably includes openings 113 therein that receive straps 114 (see FIG. 1A) that are operable to attach the foot mountable golfing aid 100 to the foot of a golfer. The straps 114 can be any type of straps that are operable to affix the foot mountable golfing aid 100 to the foot of a golfer such as straps that are tie-able, straps that are elastic, straps that include buckles, straps that include a tightening device, or straps that are velcro straps. The contoured plate 111 preferably includes a soft pad on a lower surface thereof, so as to provide cushioning between the foot attachment component 110 and the foot or shoe of a golfer. Furthermore, as the contoured plate 111 is preferably formed of plastic, the pad can reduce scuffing of a golfer's shoe during use of the foot mountable golfing aid 100.

In an embodiment, an upper portion of the contoured plate 111 of foot attachment component 110 includes a rotatable turret 112 which supports the vertically adjustable reference component 120 such that the vertically adjustable reference component 120 may be horizontally rotated (or translated) about the rotatable turret 112. The contoured plate 111 preferably also includes one or more cut outs 115 that preferably each extend between an upper and the lower surface of the contoured plate 111. The one or more cutouts 115 are configured to increase the flexibility of the contoured plate, such that a golfer has increased flexibility during practice with the foot mountable golfing aid 100 and can also bend their toes during use.

In an embodiment, the foot attachment component 110 and/or the vertically adjustable reference component 120 include a locking mechanism 116 that is operable to lock the vertically adjustable reference component in place such that the vertical height of the vertically adjustable reference component 120 may be fixed. During different types of swings such as a full swing or a putting stroke, the vertical height of the vertically adjustable reference component 120 is preferably set to a desired position. Preferably, the locking mechanism 116 is a spring loaded lock (see FIGS. 3A and 3B), a tab in groove lock (see FIGS. 1A-1D), or a tightenable fastener. In a preferred embodiment, the rotatable turret 112 includes a locking mechanism 117 that is operable to lock the vertically adjustable reference component 120 in place such that the horizontal position of the vertically adjustable reference component 120 may be fixed. Preferably, the locking mechanism 117 is a spring loaded lock (see FIGS. 3A and 3B), a tab in groove lock (see FIGS. 1A-1D), or a tightenable fastener.

The vertically adjustable reference component 120 is preferably extendable such that the horizontal distance that an end portion of the vertically adjustable reference component 120 is from a golfer may be set. For example, the boom 125 is preferably a telescoping boom 125 having at least first and second sections wherein the second section can extend into and out of the first section. For example, as shown in FIGS. 1A-1D, the boom 125 preferably includes a first section 125*a*, a second section 125*b*, and a third section 125*c* wherein the third section 125*c* can telescope into the second section 125*b* and the second section 125*b* can telescope into the first section 125*a*. In a preferred arrangement, the first section 125*a* can telescope into the base 124. Preferably the first section 125*a*, the second section 125*b*, and/or the third section 125*c* include finger tabs 128 that aid a golfer in extending or retracting a respective section of the boom 125.

Figure 1B:
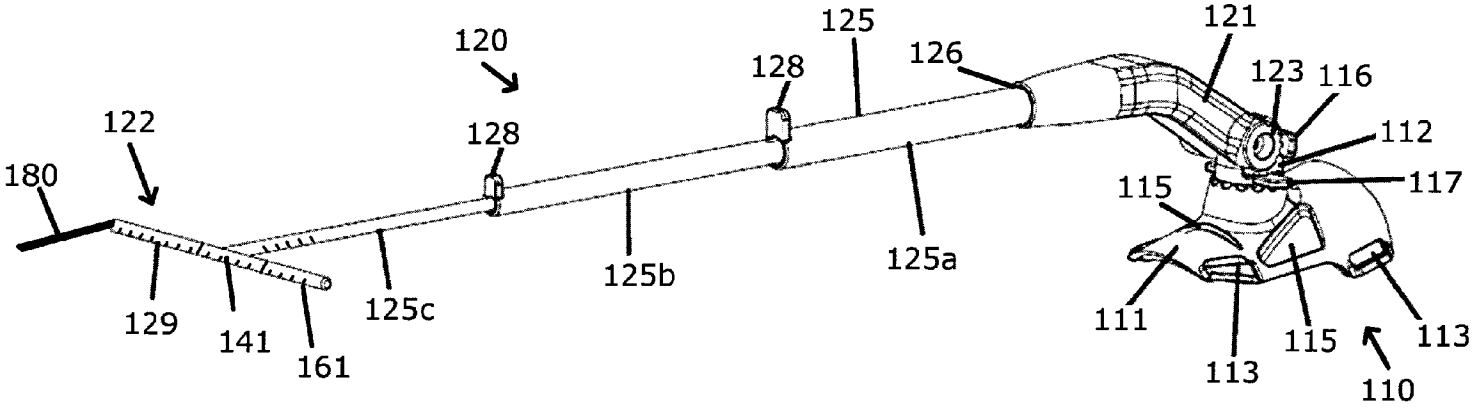
FIG. 1B illustrates an embodiment of a foot mountable golfing aid according to an embodiment as disclosed herein.
Figure 1C:
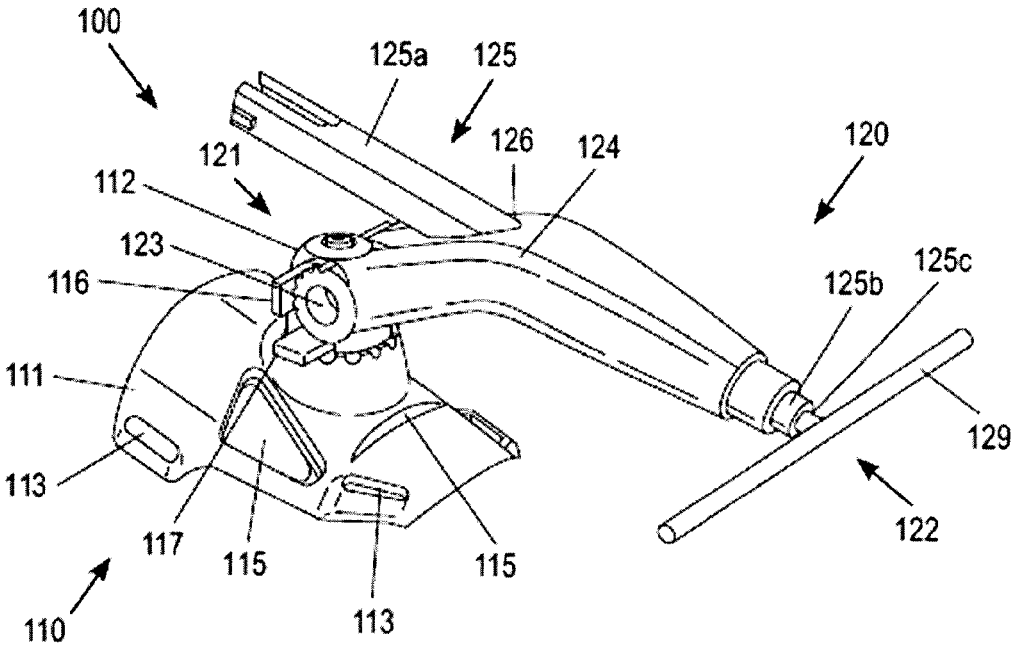
FIG. 1C illustrates an embodiment of a foot mountable golfing aid according to an embodiment as disclosed herein.
Figure 1D:
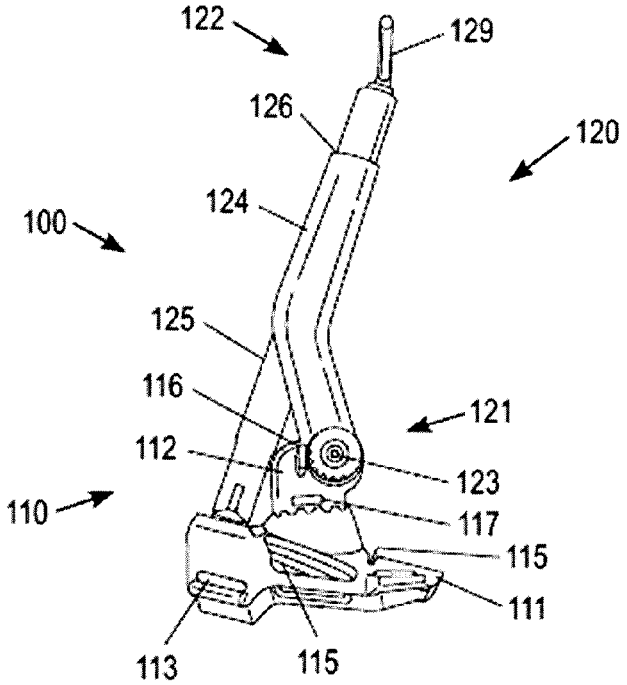
FIG. 1D illustrates an embodiment of a foot mountable golfing aid according to an embodiment as disclosed herein.

As shown in FIGS. 1A and 1B, the first, second, and third sections 125*a*, 125*b*, and 125*c* of the boom 125 are in an extended position, and as shown in FIGS. 1C and 1D, the first, second, and third sections 125*a*, 125*b*, and 125*c* of the boom 125 are in retracted position. When the first, second, and third sections 125*a*, 125*b*, and 125*c* of the boom 125 are in the retracted position, a golfer may easily walk to different locations on a golf course without the golfing aid 100 obstructing the golfer's walking path. Thus, the foot mountable golfing aid 100 is mobile with the golfer and easily usable. Therefore, a golfer can increase practice efficiency as the golfer does not need to remove the foot mountable golfing aid 100 during practice, and can adjust the golfing aid 100 to a multitude of positions for each upcoming stroke during a practice session. In this manner, a golfer can use the golfing aid 100 during practice and/or during a recreational round of golf.

In an embodiment a first section of the telescoping boom 125 can be hollow and can include at least one groove in the interior thereof and the second section of the telescoping boom 125 can include at least one rail on an exterior thereof. In this embodiment the rail of the second section fits in the groove of the first section such that the second section is aligned with the first section and the second section may be telescoped into and out of the first section. Preferably, the first section comprises two grooves in the interior thereof and the second section comprises two corresponding rails on the exterior thereof. The rails of the second section preferably provide a friction fit in the respective grooves such that second section can be telescoped within the first section to a predetermined position.

In an embodiment, the foot mountable golfing aid 100 can include a movable ball marker 160 that allows a golfer to mark the position of a golf ball. As shown in FIG. 1A, the movable ball marker 160 is located on the boom 125, however, in an alternate embodiment, the movable ball marker 160 can be located on the foot attachment component 110. In another embodiment, the cross-bar 129 and/or a portion of the boom 125 can include a position indicator 161 to indicate a relationship between a foot of a golfer and the position of a golf ball such that a golfer can consistently locate the ball at a proper position. In an embodiment, the position indicator 161 can include markings with predetermined angles, or alternatively the position indicator 161 can be a measurement device such as a ruler. In an additional embodiment, the cross-bar 129 can include a backswing rail 180 (see FIG. 1B) that is operable to limit the back swing of a golfer. The back swing rail 180 is preferably adjustable, and more preferably removable from the cross-bar 129.

Figure 2:
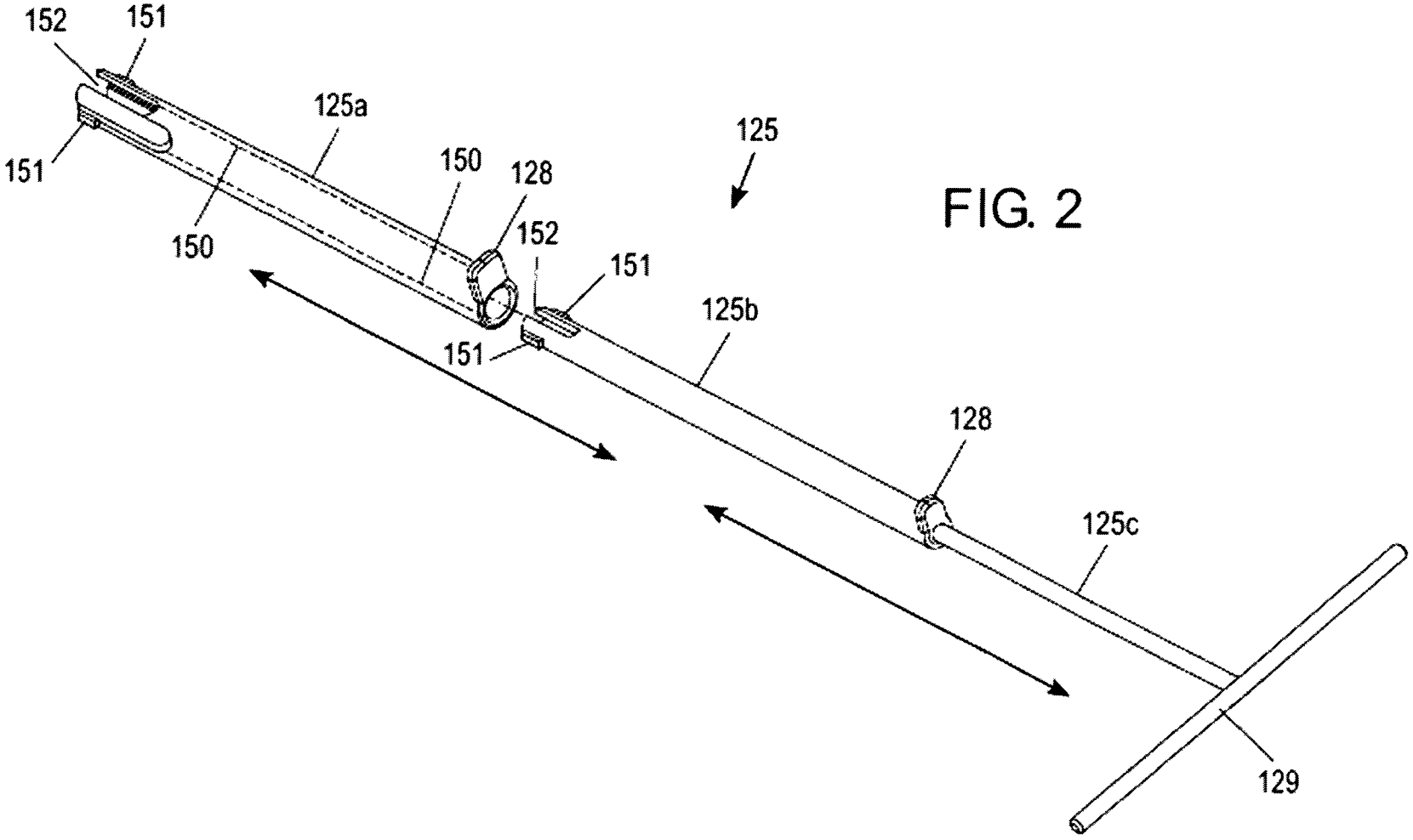
FIG. 2 illustrates an embodiment of a boom of a foot mountable golfing aid according to an embodiment as disclosed herein.

FIG. 2 illustrates a preferred embodiment of a telescoping boom. As shown in FIG. 2, the boom 125 preferably includes a first section 125*a*, a second section 125*b*, and a third section 125*c* wherein the third section 125*c* can telescope into the second section 125*b* and the second section 125*b* can telescope into the first section 125*a*. The first section 125*a* is preferably hollow and includes two grooves (i.e. guides) 150 in which two rails 151 of the second section 125*b* are inserted. The second section 125*b* is also preferably hollow and includes two grooves or guides (not shown) in which two rails (not shown) of the third section 125*c* are inserted. Likewise, the first section 125*a* can include two rails 151 that are fitted into the base 124 of the vertically adjustable reference component 120. Preferably, the first, second, and third sections 125*a*, 125*b*, 125*c* each include a cut out 152 at respective ends thereof, such that the respective ends can be fitted into an adjacent section or base and provide a friction fit within the grooves 150 such that the horizontal position of the cross-bar 129 can be finely adjusted. The first, second, and/or third sections 125*a*, 125*b*, 125*c* of the boom 125 can also include finger tabs 128 that aid a golfer in extending or retracting a respective section to a desired location.

Figure 3A:
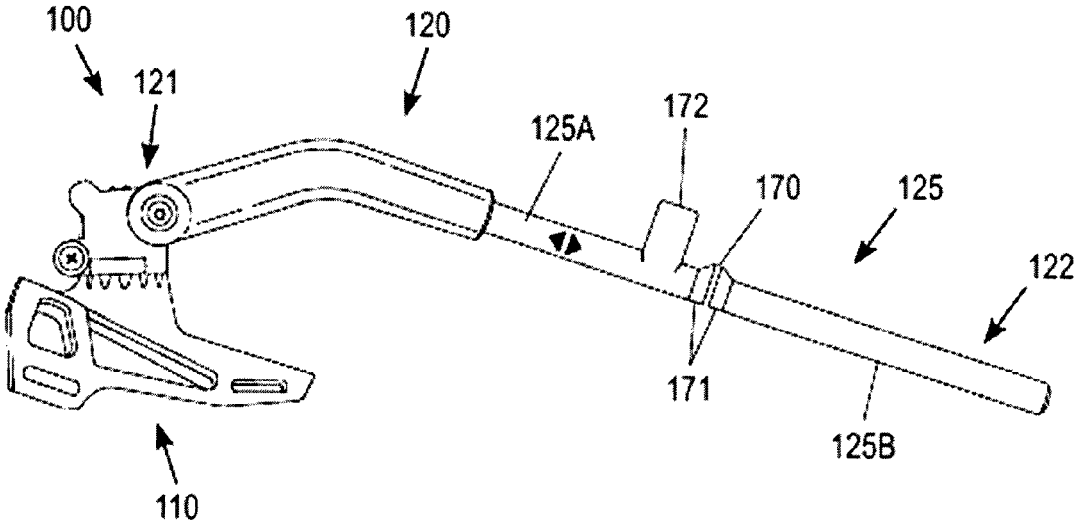
FIG. 3A illustrates an embodiment of a foot mountable golfing aid according to an embodiment as disclosed herein.
Figure 3B:
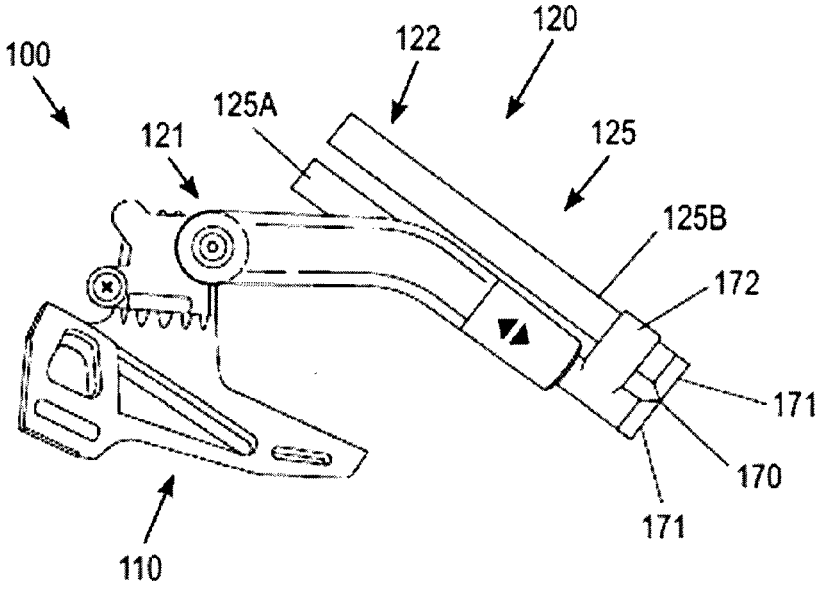
FIG. 3B illustrates an embodiment of a foot mountable golfing aid according to an embodiment as disclosed herein.

In an embodiment, the vertically adjustable reference component 120 can include a hinge 170 along a length thereof such that a second end portion 122 of the vertically adjustable reference component 120 can be folded towards a first end portion 121 of the vertically adjustable reference component 120. For example, FIGS. 3A and 3B illustrate an embodiment of a foot mountable golfing aid 100 in which the boom 125 includes a hinge 170 along the length thereof such that the boom 125 includes first and second sections 125*a*, 125*b* wherein the second section 125*b* can be folded towards the first section 125*a*. In the folded upright position (see FIG. 3B), a golfer can easily walk from spot to spot on a golf course, practice field, or practice green. In a preferred embodiment, adjacent portions of the first and second sections 125*a*, 125*b* include a magnet therein such that the respective sections are may be firmly fixed together when the boom 125 is in the extended position (see FIG. 3A). The first section 125*a* preferably includes a catch such that the second section 125*b* can be locked in place in the folded position.

Figure 4A:
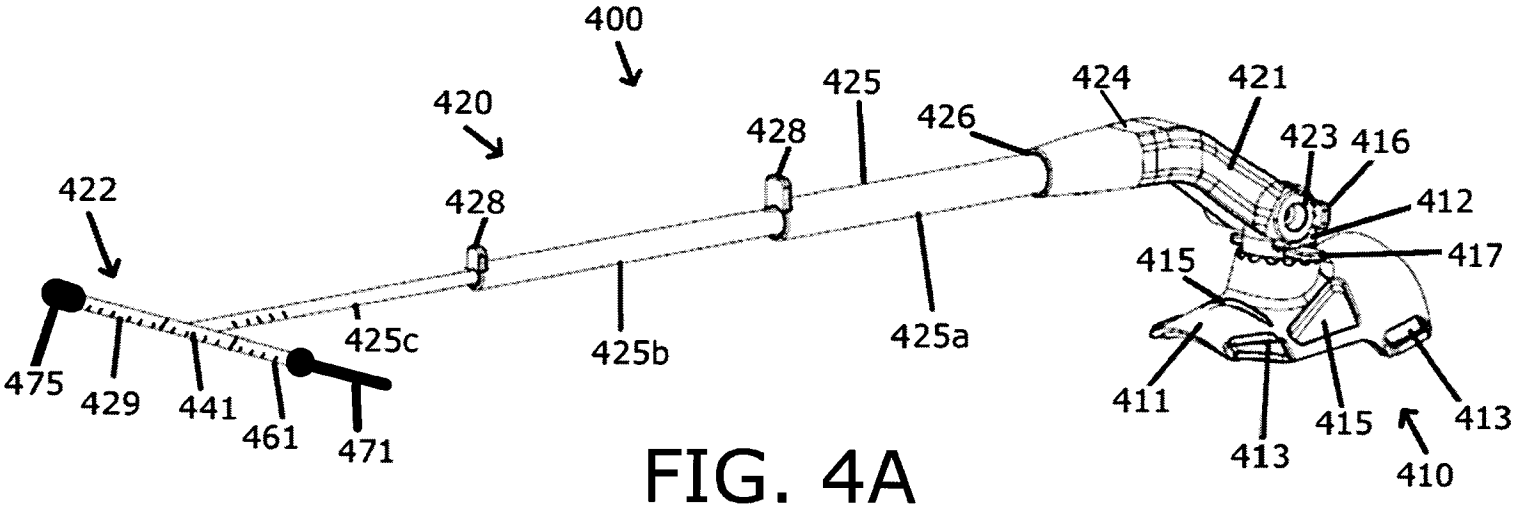
FIG. 4A illustrates an embodiment of a foot mountable golfing aid according to an embodiment as disclosed herein.

FIG. 4A illustrates an embodiment of a foot mountable golfing aid 400 according to an embodiment as disclosed herein. The foot mountable golfing aid 400 can include a foot attachment component 410 that is configured to be attached to a foot of a golfer during use, and a vertically adjustable reference component 420 that is supported by the foot attachment component 410. The vertically adjustable reference component 420 is operable to provide a reference path for a swing of a golfer, indicate a swing path, indicate a proper width of stance of a golfer, and/or aid in alignment of a golfer's body in relation to a target when the foot mountable golfing aid 400 is attached to the foot of a golfer. The vertically adjustable reference component 420 can include a first end portion 421 pivotally attached to the foot attachment component 410 at a pivot 423. The vertically adjustable reference component 420 can also include a second end portion 422 that is outward of the first end portion 421 such that the second end portion 422 may be vertically adjusted by rotating the vertically adjustable reference component 420 around the first end portion 421. The second end portion 422 preferably provides a reference path for a swing of a golfer when the foot mountable golfing aid is attached to the foot of a golfer.

In an embodiment, the second end portion 422 can include one or more lasers (not shown) that provide a reference path for a swing of a golfer wherein the one or more lasers can be directed towards the ground and/or outwardly. For example, in an embodiment, the one or more lasers can be configured to illustrate a linear reference path on the ground wherein the reference path can be configured to be parallel to a desired target line of a stroke of a golfer. In a further embodiment, the one or more lasers can be located at any position on the foot mountable golfing aid 400.

In an embodiment, the vertically adjustable reference component 420 can include a base 424 at the first end portion 421 of the vertically adjustable reference component 420. The base 424 has an opening 426 in which a boom 425 that extends outwardly from the base 424 is located. Preferably, the opening 426 is a through opening that extends completely through a portion of the base 424. The opening 426 preferably includes the boom 425 therein such that the boom 425 is movable within the opening 426 of the base 424 wherein the boom 425 may be movable among a retracted position, intermediate positions, and an extended position. In an embodiment, the boom 425 may be friction fit in the base 424 such that the position of the boom 425 may be finely adjusted within the base 424. In a preferred embodiment, the opening 426 of the base can include at least one groove (not shown) wherein at least one rail (not shown) on the boom 425 is fitted in the groove such that the boom 425 is aligned in the base 424, or in an alternate embodiment the base can include at least one rail that is fitted in a groove of the boom.

In an alternate embodiment, the vertically adjustable reference component 420 can include a boom 425 having a first end portion pivotally attached to the foot attachment component 410 and a second end portion outward of the first end portion. The second end portion may be vertically adjusted by rotating the vertically adjustable reference component around the first end, wherein the second end portion provides the reference path for a swing of a golfer when the foot mountable golfing aid is attached to the foot of a golfer. In an alternative embodiment, the vertically adjustable reference component can include a boom 425 that can have a first portion that is vertical or substantially vertical to the foot attachment component 410 and a second portion that extends horizontally from the first portion. The first section of the boom 425 in this embodiment may be extendable such that the vertical height of the boom may be increased or decreased. Likewise, the second section of the boom can be extendable such that the horizontal length of the boom may be increased or decreased.

Referring back to FIG. 4A, the boom 425 can include a cross-bar 429 at the end thereof wherein the cross-bar 429 is configured to provide a reference path for a swing of a golfer when the foot mountable golfing aid is attached to the foot of a golfer. Preferably the cross-bar 429 extends perpendicular to the length of the boom 425. In an embodiment, the cross-bar 429 may be integral with the boom 425, in an alternative embodiment, the cross-bar 429 may be attached to the end of the boom 425 with screws or the like. For example, the cross-bar 429 may include two pieces that each screw into the boom 425, such that the cross-bar 429 may be removed. In a different embodiment, the cross-bar 429 can be a single piece that screws into the end of the boom 425. In an embodiment, the cross-bar 429 can include a level 441, such as a bubble level or digital level, wherein the level may indicate the slope of the ground in which a golfer is standing. The level 441 can indicate to a golfer when the golfer needs to adjust ball position or their stance such as when a golf ball has an uneven lie in the fair way. Preferably the level 441 is at the center of the cross-bar 429, however the level 441 can be included in any position on the golfing aid 400. In an embodiment, the level 441 and/or the laser, as well as other electronic functions of the golfing aid 400, can communicate with a golfer's cell phone via a cell phone application and blue tooth or the like. In this embodiment, the golf aid 400 includes the necessary electrical components such as a logic controller, power source, and the like.

In an embodiment, the cross-bar 429 can include a cross-bar extension member 471. The cross-bar extension member 471 is operable to extend the length that the cross-bar 429 extends laterally outward from the boom 425. The cross-bar extension member 471 can be made of a flexible or semi-rigid material, such as an elastomeric or rubber material. The cross-bar extension member 471 is formed of a material that is more flexible than the cross-bar 429 so as to provide a region of the foot mountable golfing aid 400 that can be repeatedly impacted by a golf club without causing damage to the golf club, or to the foot mountable golfing aid.

Figure 4B:
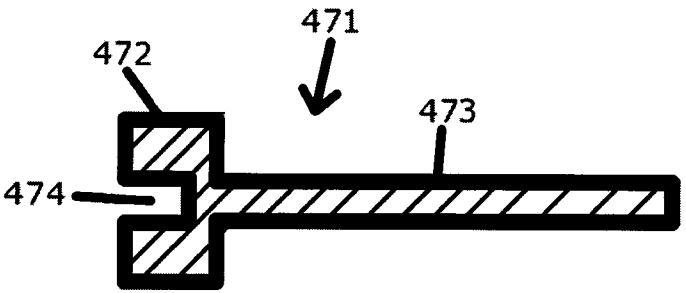
FIG. 4B shows a cross section of a cross-bar extension member of a foot mountable golfing aid according to an embodiment as disclosed herein.

The cross-bar extension member 471 is preferably configured to attach and detach from an outer end of the cross-bar 429. For example, the cross-bar extension member 471 can include a connection portion 472 (see FIG. 4B), and an extension portion 473 (see FIG. 4B) that extends outwardly from the connection portion 472. In an embodiment, the connection portion can include an orifice 474 that receives an end of the cross-bar 429 such that the cross-bar extension member 471 may be attached to the cross-bar 429 via a friction fit. Alternatively, the connection portion 472 can be configured to screw into or on an end of the cross-bar 429. In this manner, a golfer can select and attach different cross-bar extension members 471 that each have different respective dimensions to the cross-bar 429, such as cross-bar extension members having extension portions of differing lengths. In an alternative embodiment, the cross-bar extension member 471 can be permanently affixed to an outer end of the cross-bar 429. FIG. 4B shows a cross section of a cross-bar extension member 471 having a connection portion 472 and an extension portion 473 that extends outwardly from the connection portion. The connection portion 472 includes an orifice 474 operable to receive an end of the cross-bar 429, such that the cross-bar extension member 471 may be attached to the cross-bar 429 and detached from the cross-bar 429. In an embodiment, the cross-bar extension member 471 is generally cylindrical wherein the orifice 474 is coaxial with the extension portion 473. In an alternative embodiment, the orifice 474 may be offset from the extension portion 473. In an embodiment, the cross-bar extension member 471 can be cylindrical and configured to attach to an end of the cross-bar 429 wherein the radius of the connection portion 472 of the cross-bar extension member 471 is about equal to or less than the radius of the cross-bar 429.

In an embodiment, the cross-bar can include a cross-bar counter weight 475. The cross-bar counter weight 475 is operable to balance the cross-bar 429 of the foot mountable golfing aid 400 such that the cross-bar 429 remains parallel to the ground. Preferably, the cross-bar counter weight 475 provides a counter balance to a cross-bar extension member 471, wherein the weight of the cross-bar counter weight is selected to correspond to the weight of the respective cross-bar extension member.

The cross-bar counter weight 475 is preferably configured to attach and detach from an outer end of the cross-bar 429. The cross-bar counter weight 475 can include an orifice 476 (see FIG. 4C) that receives an end of the cross-bar 429 such that the cross-bar counter weight 475 may be attached to the cross-bar 429 via a friction fit. Alternatively, the cross-bar counter weight 475 can be configured to screw into or on an end of the cross-bar 429. In this manner, a golfer can select and attach different cross-bar counter weights 475, having differing weights, such that the weight of a respective cross-bar counter weight can correspond to that of a respective cross-bar extension members 471. In an alternative embodiment, the cross-bar counter weight 475 can be permanently affixed to an outer end of the cross-bar 429.

Figure 4C:
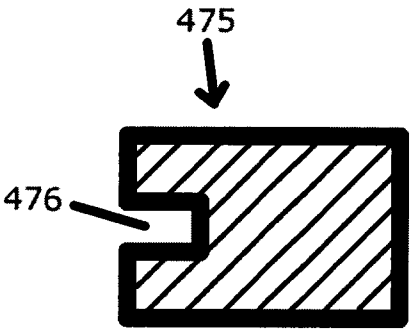
FIG. 4C shows a cross section of a cross-bar counterweight of a foot mountable golfing aid according to an embodiment as disclosed herein.

FIG. 4C shows a cross section of a cross-bar counter weight 475 having an orifice 476. In an embodiment, the orifice 476 can be a through hole that extends through the entire cross-bar counter weight 475. In an embodiment, the cross-bar counter weight 475 is generally cylindrical wherein the orifice 476 is centered in an end of the cross-bar counter weight 475. In an alternative embodiment, the orifice 476 may be offset from a central axis of the cross-bar counter weight 475. In an embodiment, the cross-bar counterweight 475 can be cylindrical and configured to attach to an end of the cross-bar 429 wherein the radius of the cross-bar counterweight 475 is about equal to or less than the radius of the cross-bar 429.

In an embodiment, the foot attachment component 410 can include a contoured plate 411 that is configured to fit against an upper portion of a foot or shoe of a golfer when attached to the foot of a golfer. Preferably, the contoured plate 411 is contoured such that the foot attachment component 410 can be attached to the left or right foot of golfer, however in a further embodiment, the contoured plate 411 can be contoured for a right foot of a golfer or a left foot of a golfer. The contoured plate 411 preferably includes openings 413 therein that receive straps (not shown) that are operable to attach the foot mountable golfing aid 400 to the foot of a golfer. The straps can be any type of straps that are operable to affix the foot mountable golfing aid 400 to the foot of a golfer such as straps that are tie-able, straps that are elastic, straps that include buckles, straps that include a tightening device, or straps that are velcro straps. The contoured plate 411 preferably includes a soft pad on a lower surface thereof, so as to provide cushioning between the foot attachment component 410 and the foot or shoe of a golfer. Furthermore, as the contoured plate 411 is preferably formed of plastic, the pad can reduce scuffing of a golfer's shoe during use of the foot mountable golfing aid 400.

In an embodiment, an upper portion of the contoured plate 411 of foot attachment component 410 includes a rotatable turret 412 which supports the vertically adjustable reference component 420 such that the vertically adjustable reference component 420 may be horizontally rotated (or translated) about the rotatable turret 412. The contoured plate 411 preferably also includes one or more cut outs 415 that preferably each extend between an upper and the lower surface of the contoured plate 411. The one or more cutouts 415 are configured to increase the flexibility of the contoured plate, such that a golfer has increased flexibility during practice with the foot mountable golfing aid 400 and can also bend their toes during use.

In an embodiment, the foot attachment component 410 and/or the vertically adjustable reference component 420 include a locking mechanism 416 that is operable to lock the vertically adjustable reference component in place such that the vertical height of the vertically adjustable reference component 420 may be fixed. During different types of swings such as a full swing or a putting stroke, the vertical height of the vertically adjustable reference component 420 is preferably set to a desired position. Preferably, the locking mechanism 416 is a spring loaded lock, a tab in groove lock, or a tightenable fastener. In a preferred embodiment, the rotatable turret 412 includes a locking mechanism 417 that is operable to lock the vertically adjustable reference component 420 in place such that the horizontal position of the vertically adjustable reference component 420 may be fixed. Preferably, the locking mechanism 417 is a spring loaded lock, a tab in groove lock, or a tightenable fastener.

The vertically adjustable reference component 420 is preferably extendable such that the horizontal distance that an end portion of the vertically adjustable reference component 420 is from a golfer may be set. For example, the boom 425 is preferably a telescoping boom 425 having at least first and second sections wherein the second section can extend into and out of the first section. For example, the boom 425 preferably includes a first section 425*a*, a second section 425*b*, and a third section 425*c* wherein the third section 425*c* can telescope into the second section 425*b* and the second section 425*b* can telescope into the first section 425*a*, or vice versa. In a preferred arrangement, the first section 425*a* can telescope into the base 424. Preferably the first section 425*a*, the second section 425*b*, and/or the third section 425*c* include finger tabs 428 that aid a golfer in extending or retracting a respective section of the boom 425.

In an embodiment a first section of the telescoping boom 425 can be hollow and can include at least one groove in the interior thereof, and the second section of the telescoping boom 425 can include at least one rail on an exterior thereof. In this embodiment the rail of the second section fits in the groove of the first section such that the second section is aligned with the first section and the second section may be telescoped into and out of the first section. Preferably, the first section comprises two grooves in the interior thereof and the second section comprises two corresponding rails on the exterior thereof. The rails of the second section preferably provide a friction fit in the respective grooves such that second section can be telescoped within the first section to a predetermined position.

In an embodiment, the foot mountable golfing aid 400 can include a movable ball marker (not shown) that allows a golfer to mark the position of a golf ball. In an embodiment, the cross-bar 429 and/or a portion of the boom 425 can include a position indicator 461 to indicate a relationship between a foot of a golfer and the position of a golf ball such that a golfer can consistently locate the ball at a proper position. In an embodiment, the position indicator 461 can include markings with predetermined angles, or alternatively the position indicator 461 can be a measurement device such as a ruler.

Figure 5A:
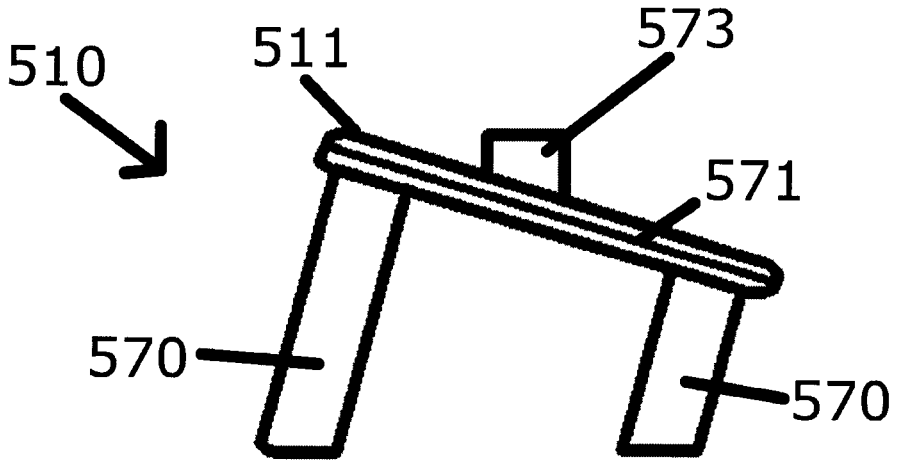
FIG. 5A illustrates an embodiment of a contoured plate of a foot mountable golfing aid according to an embodiment as disclosed herein.

FIG. 5A illustrates an embodiment of a foot attachment component 510 of a foot mountable golfing aid according to an embodiment as disclosed herein. In this embodiment, a contoured plate 511 of the foot attachment component 510 is configured to fit against an upper portion of a foot of a golfer wherein the foot attachment component 510 is located between a golfer's foot and a golfer's shoe that the golfer is wearing. Preferably, the contoured plate 511 is contoured such that the foot attachment component 510 can be attached to the left or right foot of golfer, however in a further embodiment, the contoured plate 511 can be contoured for a right foot of a golfer or a left foot of a golfer.

Figure 5B:
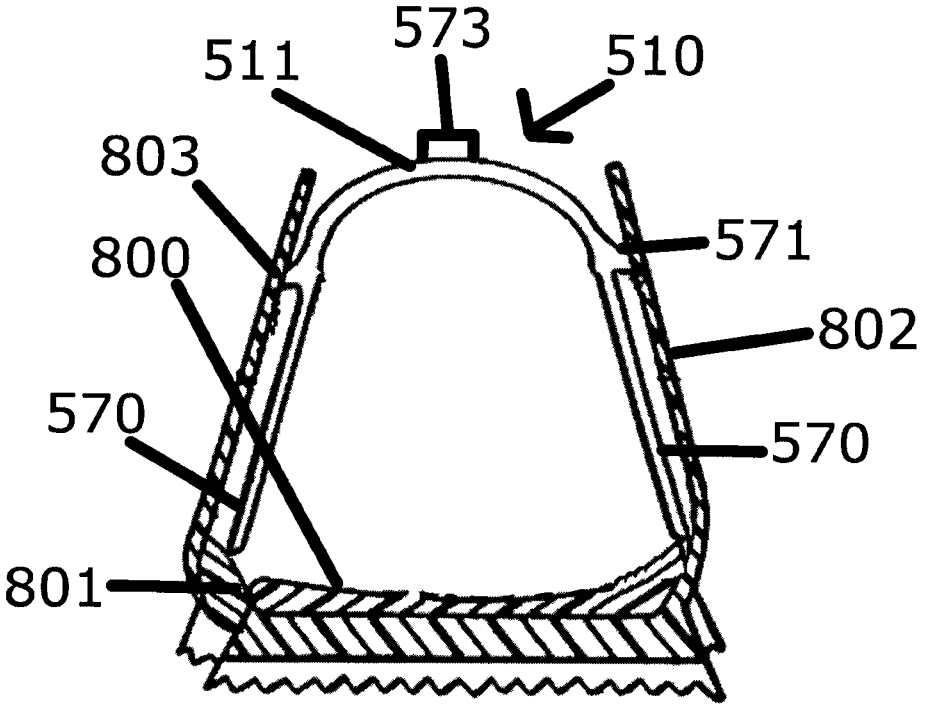
FIG. 5B illustrates an embodiment of a contoured plate of a foot mountable golfing aid according to an embodiment as disclosed herein.

In an embodiment, the contoured plate 511 can include openings therein that receive straps (not shown) that are operable to attach a foot mountable golfing aid to the foot of a golfer. The straps can be any type of straps that are operable to affix the foot mountable golfing aid to the foot of a golfer such as straps that are tie-able, straps that are elastic, straps that include buckles, straps that include a tightening device, or straps that are velcro straps. In this embodiment, a golfer preferably puts the foot attachment component 510 on his or her foot, and then inserts his or her foot in a shoe. The contoured plate 511 preferably includes a soft pad on a lower surface thereof, so as to provide cushioning between the foot attachment component 510 and the foot or shoe of a golfer. In the embodiment as shown in FIG. 5A, the foot attachment component 510 includes supports 570 that extend downwardly from the contoured plate 511, and are configured to extend past the respective sides of a golfer's foot. FIG. 5B shows a cross section of the foot attachment component 510 within a golfer's shoe 800. As shown in FIG. 5B, the supports 570 preferably contact and are supported on an upper surface 800 of a sole 801 within a golfer's shoe 802. The contoured plate 511 is preferably configured such that the tongue (not shown) of the golfer's shoe extends over an upper surface thereof. In an embodiment, the contoured plate 511 can include a rail 571 that is received in a groove 803 in an inner surface of the golfer's shoe 802, such that the foot attachment component 510 is fixed in the golfer's shoe 802. Preferably, the groove 803 is in an upper inner surface of the golfer's shoe 802.

In an embodiment, an upper portion of the contoured plate 511 of foot attachment component 510 includes a connection 573 that is operable to connect to a rotatable turret (not shown) which supports a vertically adjustable reference component according to embodiments described herein. The vertically adjustable reference component may be horizontally rotated (or translated) about the rotatable turret. The contoured plate 511 preferably also includes one or more cut outs (not shown) that preferably each extend between an upper and the lower surface of the contoured plate 511. The one or more cutouts are configured to increase the flexibility of the contoured plate 511, such that a golfer has increased flexibility during practice with the foot mountable golfing aid and can also bend their toes during use.

Figure 6A:
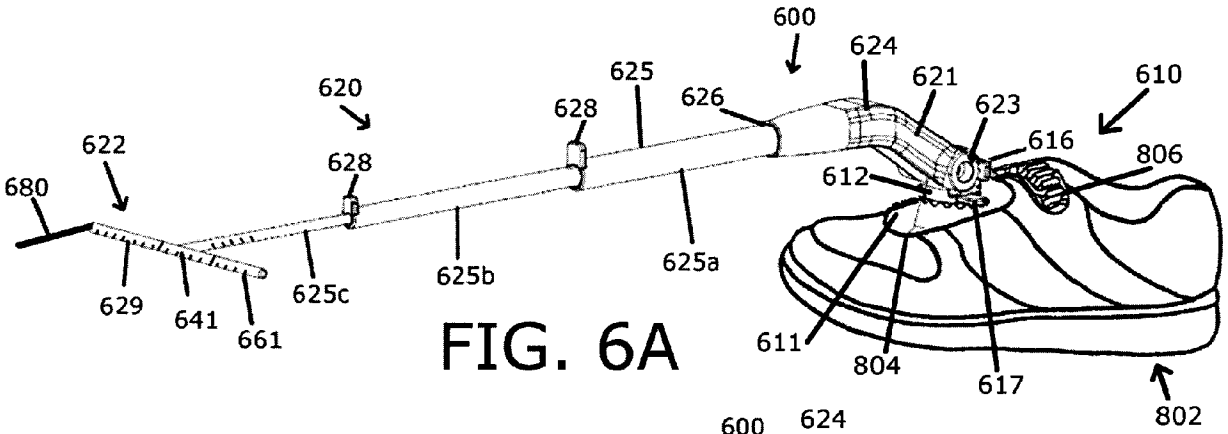
FIG. 6A illustrates an embodiment of a foot mountable golfing aid according to an embodiment as disclosed herein.

FIG. 6A illustrates an embodiment of a foot mountable golfing aid 600 according to an embodiment as disclosed herein. The foot mountable golfing aid 600 can include a foot attachment component 610 that is configured to be attached to a shoe 802 of a golfer during use, and a vertically adjustable reference component 620 that is supported by the foot attachment component 610. The vertically adjustable reference component 620 is operable to provide a reference path for a swing of a golfer, indicate a swing path, indicate a proper width of stance of a golfer, and/or aid in alignment of a golfer's body in relation to a target when the foot mountable golfing aid 600 is attached to the foot of a golfer. The vertically adjustable reference component 620 can include a first end portion 621 pivotally attached to the foot attachment component 610 at a pivot 623. The vertically adjustable reference component 620 can also include a second end portion 622 that is outward of the first end portion 621 such that the second end portion 622 may be vertically adjusted by rotating the vertically adjustable reference component 620 around the first end portion 621. The second end portion 622 preferably provides a reference path for a swing of a golfer when the foot mountable golfing aid is attached to the foot of a golfer.

In an embodiment, the second end portion 622 can include one or more lasers (not shown) that provide a reference path for a swing of a golfer wherein the one or more lasers can be directed towards the ground and/or outwardly. For example, in an embodiment, the one or more lasers can be configured to illustrate a linear reference path on the ground wherein the reference path can be configured to be parallel to a desired target line of a stroke of a golfer. In a further embodiment, the one or more lasers can be located at any position on the foot mountable golfing aid 600.

In an embodiment, the vertically adjustable reference component 620 can include a base 624 at the first end portion 621 of the vertically adjustable reference component 620. The base 624 has an opening 626 in which a boom 625 that extends outwardly from the base 624 is located. Preferably, the opening 626 is a through opening that extends completely through a portion of the base 624. The opening 626 preferably includes the boom 625 therein such that the boom 625 is movable within the opening 626 of the base 624 wherein the boom 625 may be movable among a retracted position, intermediate positions, and an extended position. In an embodiment, the boom 625 may be friction fit in the base 624 such that the position of the boom 625 may be finely adjusted within the base 624. In a preferred embodiment, the opening 626 of the base can include at least one groove (not shown) wherein at least one rail (not shown) on the boom 625 is fitted in the groove such that the boom 625 is aligned in the base 624, or in an alternate embodiment the base can include at least one rail that is fitted in a groove of the boom.

In an alternate embodiment, the vertically adjustable reference component 620 can include a boom 625 having a first end portion pivotally attached to the foot attachment component 610 and a second end portion outward of the first end portion. The second end portion may be vertically adjusted by rotating the vertically adjustable reference component around the first end, wherein the second end portion provides the reference path for a swing of a golfer when the foot mountable golfing aid is attached to the foot of a golfer. In an alternative embodiment, the vertically adjustable reference component can include a boom 625 that can have a first portion that is vertical or substantially vertical to the foot attachment component 610 and a second portion that extends horizontally from the first portion. The first section of the boom 625 in this embodiment may be extendable such that the vertical height of the boom may be increased or decreased. Likewise, the second section of the boom can be extendable such that the horizontal length of the boom may be increased or decreased.

Referring back to FIG. 4A, the boom 625 can include a cross-bar 629 at the end thereof wherein the cross-bar 629 is configured to provide a reference path for a swing of a golfer when the foot mountable golfing aid is attached to the foot of a golfer. Preferably the cross-bar 629 extends perpendicular to the length of the boom 625. In an embodiment, the cross-bar 629 may be integral with the boom 625, in an alternative embodiment, the cross-bar 629 may be attached to the end of the boom 625 with screws or the like. For example, the cross-bar 629 may include two pieces that each screw into the boom 625, such that the cross-bar 629 may be removed. In a different embodiment, the cross-bar 629 can be a single piece that screws into the end of the boom 625. In an embodiment, the cross-bar 629 can include a level 641, such as a bubble level or digital level, wherein the level may indicate the slope of the ground in which a golfer is standing. The level 641 can indicate to a golfer when the golfer needs to adjust ball position or their stance such as when a golf ball has an uneven lie in the fair way. Preferably the level 641 is at the center of the cross-bar 629, however the level 641 can be included in any position on the golfing aid 600. In an embodiment, the level 641 and/or the laser, as well as other electronic functions of the golfing aid 600, can communicate with a golfer's cell phone via a cell phone application and blue tooth or the like. In this embodiment, the golf aid 600 includes the necessary electrical components such as a logic controller, power source, and the like. In an embodiment, the cross-bar 629 can include a cross-bar extension member 671 and/or cross-bar counter weight 675 as described with respect to FIGS. 5A-5C.

In an embodiment, the foot attachment component 610 can include a contoured plate 611 and a golf aid shoe 802 wherein the contoured plate 611 is configured to attach to the golf aid shoe 802. For example, the golf aid shoe 802 can include a contoured plate receptacle 804 that is operable to fixedly attach to the contoured plate 611. In an embodiment, the contoured plate 611 can include rails that are configured to slide in corresponding grooves of the golf aid shoe 802. Alternatively, the contoured plate 611 can be configured to snap into the contoured plate receptacle 804. In an embodiment, the golf aid shoe 802 can be tightened on a golfer's foot via a Velcro strap 806. In an alternative embodiment, the contoured plate 611 can include openings configured to receive shoe laces of the golf aid shoe 802. The contoured plate 611 can include a soft pad on a lower surface thereof, so as to provide cushioning between the contoured plate 611 and the foot of a golfer.

In an embodiment, an upper portion of the contoured plate 611 of foot attachment component 610 includes a rotatable turret 612 which supports the vertically adjustable reference component 620 such that the vertically adjustable reference component 620 may be horizontally rotated (or translated) about the rotatable turret 612. The contoured plate 611 can also include one or more cut outs (not shown) that preferably each extend between an upper and the lower surface of the contoured plate 611. The one or more cutouts are configured to increase the flexibility of the contoured plate, such that a golfer has increased flexibility during practice with the foot mountable golfing aid 600 and can also bend their toes during use.

Figure 6B:
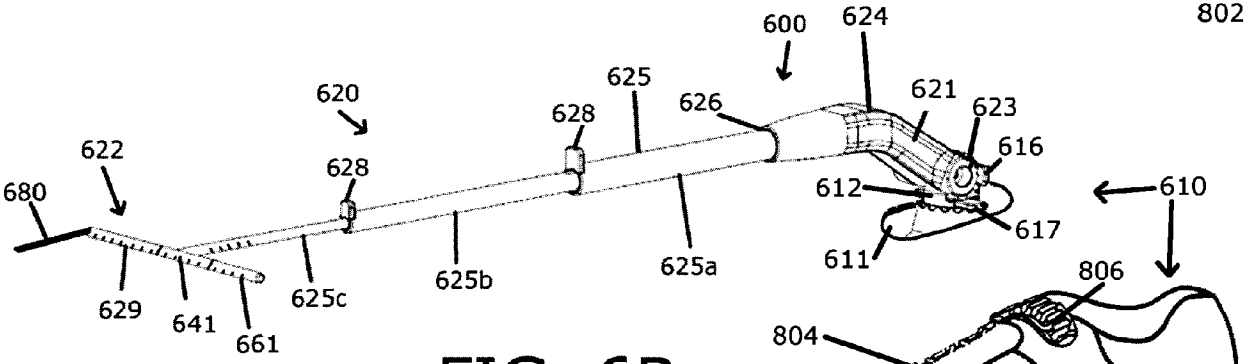
FIG. 6B illustrates an embodiment of a foot mountable golfing aid according to an embodiment as disclosed herein.
Figure 6C:
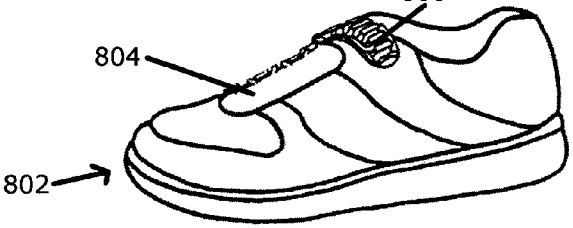
FIG. 6C illustrates an embodiment of a shoe of a foot mountable golfing aid according to an embodiment as disclosed herein.

In an embodiment, the contoured plate 611 is operable to be removed from the golf aid shoe 800. For example, FIG. 6B illustrates an embodiment of a vertically adjustable reference component 620 that is detached from a golf aid shoe 802 (see FIG. 6C). Alternatively, the contoured plate 611 can be permanently fixed to the golf aid shoe 802.

In an embodiment, the foot attachment component 610 and/or the vertically adjustable reference component 620 include a locking mechanism 616 that is operable to lock the vertically adjustable reference component in place such that the vertical height of the vertically adjustable reference component 620 may be fixed. During different types of swings such as a full swing or a putting stroke, the vertical height of the vertically adjustable reference component 620 is preferably set to a desired position. Preferably, the locking mechanism 616 is a spring loaded lock, a tab in groove lock, or a tightenable fastener. In a preferred embodiment, the rotatable turret 612 includes a locking mechanism 617 that is operable to lock the vertically adjustable reference component 620 in place such that the horizontal position of the vertically adjustable reference component 620 may be fixed. Preferably, the locking mechanism 617 is a spring loaded lock, a tab in groove lock, or a tightenable fastener.

The vertically adjustable reference component 620 is preferably extendable such that the horizontal distance that an end portion of the vertically adjustable reference component 620 is from a golfer may be set. For example, the boom 625 is preferably a telescoping boom 625 having at least first and second sections wherein the second section can extend into and out of the first section. For example, the boom 625 preferably includes a first section 625*a*, a second section 625*b*, and a third section 625*c* wherein the third section 625*c* can telescope into the second section 625*b* and the second section 625*b* can telescope into the first section 625*a*, or vice versa. In a preferred arrangement, the first section 625*a* can telescope into the base 624. Preferably the first section 625*a*, the second section 625*b*, and/or the third section 625*c* include finger tabs 628 that aid a golfer in extending or retracting a respective section of the boom 625.

In an embodiment a first section of the telescoping boom 625 can be hollow and can include at least one groove in the interior thereof, and the second section of the telescoping boom 625 can include at least one rail on an exterior thereof. In this embodiment the rail of the second section fits in the groove of the first section such that the second section is aligned with the first section and the second section may be telescoped into and out of the first section. Preferably, the first section comprises two grooves in the interior thereof and the second section comprises two corresponding rails on the exterior thereof. The rails of the second section preferably provide a friction fit in the respective grooves such that second section can be telescoped within the first section to a predetermined position.

In an embodiment, the foot mountable golfing aid 600 can include a movable ball marker (not shown) that allows a golfer to mark the position of a golf ball. In an embodiment, the cross-bar 629 and/or a portion of the boom 625 can include a position indicator 661 to indicate a relationship between a foot of a golfer and the position of a golf ball such that a golfer can consistently locate the ball at a proper position. In an embodiment, the position indicator 661 can include markings with predetermined angles, or alternatively the position indicator 661 can be a measurement device such as a ruler. In an additional embodiment, the cross-bar 629 can include a backswing rail 680 that is operable to limit the back swing of a golfer. The back swing rail 680 is preferably adjustable, and more preferably removable from the cross-bar 629.

Figure 7A:
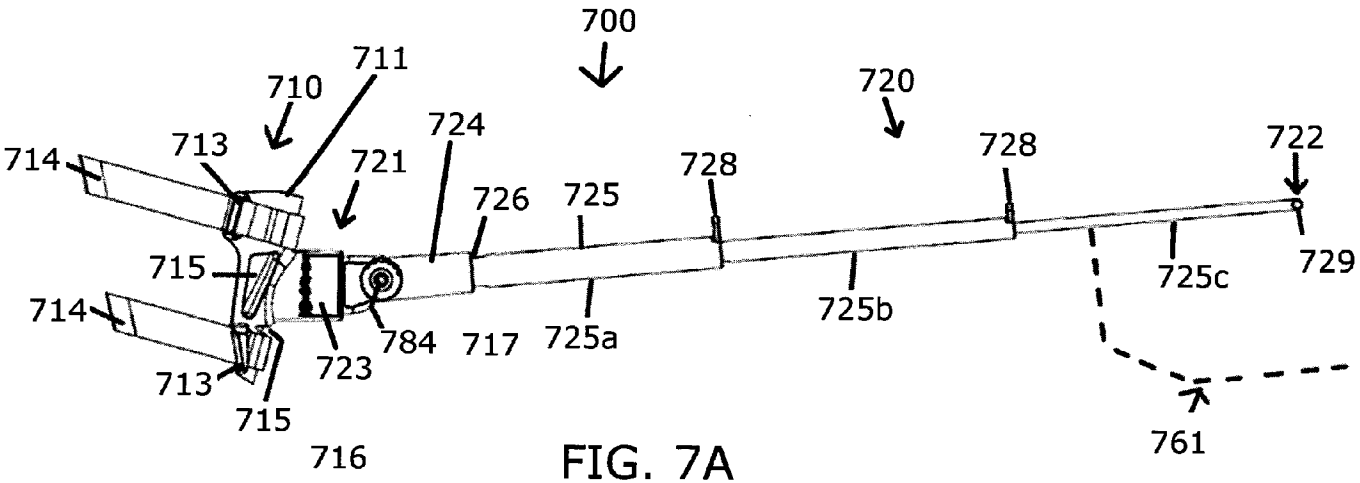
FIG. 7A illustrates an embodiment of a shin mountable golfing aid according to an embodiment as disclosed herein.
Figure 7B:
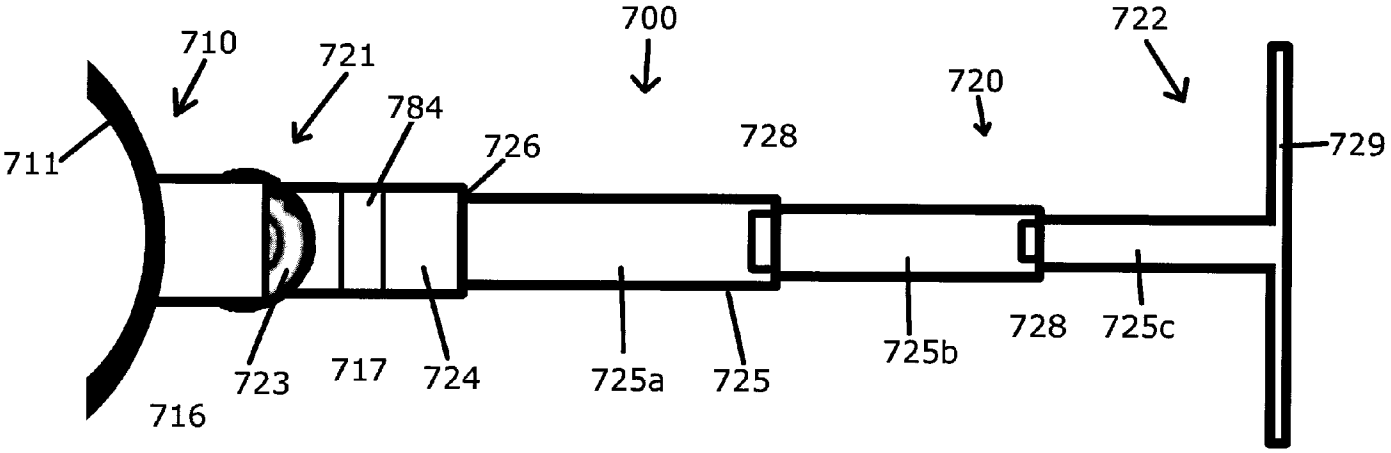
FIG. 7B illustrates an embodiment of a shin mountable golfing aid according to an embodiment as disclosed herein.

FIGS. 7A and 7B illustrate an embodiment of a shin mountable golfing aid 700 according to an embodiment as disclosed herein. The shin mountable golfing aid 700 can include a shin attachment component 710 that is configured to be attached to a shin of a golfer during use, and a vertically adjustable reference component 720 that is supported by the shin attachment component 710. The vertically adjustable reference component 720 is operable to provide a reference path for a swing of a golfer, indicate a swing path, indicate a proper width of stance of a golfer, and/or aid in alignment of a golfer's body in relation to a target when the shin mountable golfing aid 700 is attached to the shin of a golfer. The vertically adjustable reference component 720 can include a first end portion 721 pivotally attached to the shin attachment component 710 at a horizontally rotating pivot 723 and a vertically rotating pivot 784. The vertically adjustable reference component 720 can also include a second end portion 722 that is outward of the first end portion 721 such that the second end portion 722 may be vertically adjusted by rotating the vertically adjustable reference component 720 around the first end portion 721 at the vertically rotating pivot 784, and the second end portion 722 may be horizontally adjusted by rotating the vertically adjustable reference component 720 around the first end portion 721 at the horizontally rotating pivot 723. The second end portion 722 preferably provides a reference path for a swing of a golfer when the shin mountable golfing aid is attached to the shin of a golfer.

In an embodiment, the second end portion 722 can include one or more lasers (not shown) that provide a reference path for a swing of a golfer wherein the one or more lasers can be directed towards the ground and/or outwardly. For example, in an embodiment, the one or more lasers can be configured to illustrate a linear reference path on the ground wherein the reference path can be configured to be parallel to a desired target line of a stroke of a golfer. In a further embodiment, the one or more lasers can be located at any position on the shin mountable golfing aid 700.

In an embodiment, the vertically adjustable reference component 720 can include a base 724 at the first end portion 721 of the vertically adjustable reference component 720. The base 724 has an opening 726 in which a boom 725 that extends outwardly from the base 724 is located. Preferably, the opening 726 is a through opening that extends completely through a portion of the base 724. In an embodiment, the boom 725 may be friction fit in the base 724.

In an alternate embodiment, the vertically adjustable reference component 720 can include a boom 725 having a first end portion pivotally attached to the shin attachment component 710 and a second end portion outward of the first end portion. The second end portion may be vertically adjusted by rotating the vertically adjustable reference component around the first end, wherein the second end portion provides the reference path for a swing of a golfer when the shin mountable golfing aid is attached to the shin of a golfer. In an alternative embodiment, the vertically adjustable reference component can include a boom 725 that can have a first portion that is vertical or substantially vertical to the shin attachment component 710 and a second portion that extends horizontally from the first portion. The first section of the boom 725 in this embodiment may be extendable such that the vertical height of the boom may be increased or decreased. Likewise, the second section of the boom can be extendable such that the horizontal length of the boom may be increased or decreased.

Referring back to FIGS. 7A and 7B, the boom 725 can include a cross-bar 729 at the end thereof wherein the cross-bar 729 is configured to provide a reference path for a swing of a golfer when the shin mountable golfing aid is attached to the shin of a golfer. Preferably the cross-bar 729 extends perpendicular to the length of the boom 725. In an embodiment, the cross-bar 729 may be integral with the boom 725, in an alternative embodiment, the cross-bar 729 may be attached to the end of the boom 725 with screws or the like. For example, the cross-bar 729 may include two pieces that each screw into the boom 725, such that the cross-bar 729 may be removed. In a different embodiment, the cross-bar 729 can be a single piece that screws into the end of the boom 725. In an embodiment, the cross-bar 729 can include a level (not shown), such as a bubble level or digital level, wherein the level may indicate the slope of the ground in which a golfer is standing. The level can indicate to a golfer when the golfer needs to adjust ball position or their stance such as when a golf ball has an uneven lie in the fair way. Preferably the level is at the center of the cross-bar 729, however the level can be included in any position on the golfing aid 700. In an embodiment, the level and/or the laser, as well as other electronic functions of the golfing aid 700, can communicate with a golfer's cell phone via a cell phone application and blue tooth or the like. In this embodiment, the golf aid 700 includes the necessary electrical components such as a logic controller, power source, and the like. In an embodiment, the cross-bar can include a cross-bar extension member and/or cross-bar counter weight as described with respect to FIGS. 5A-5C.

In an embodiment, the shin attachment component 710 can include a contoured plate 711 that is configured to fit against an outer portion of a shin of a golfer when attached to the shin of a golfer. Preferably, the contoured plate 711 is contoured such that the shin attachment component 710 can be attached to the left or right shin of golfer, however in a further embodiment, the contoured plate 711 can be contoured for a right shin of a golfer or a left shin of a golfer. The contoured plate 711 preferably includes openings 713 therein that receive straps 714 (see FIG. 7A) that are operable to attach the shin mountable golfing aid 700 to the shin of a golfer. The straps can be any type of straps that are operable to affix the shin mountable golfing aid 700 to the shin of a golfer such as straps that are tie-able, straps that are elastic, straps that include buckles, straps that include a tightening device, or straps that are velcro straps. The contoured plate 711 preferably includes a soft pad on a lower surface thereof, so as to provide cushioning between the shin attachment component 710 and the shin of a golfer.

The contoured plate 711 preferably also includes one or more cut outs 715 configured to increase the flexibility of the contoured plate, such that a golfer has increased flexibility during practice with the shin mountable golfing aid 700.

In an embodiment, the shin attachment component 710 and/or the vertically adjustable reference component 720 include a locking mechanism 716 that is operable to lock the vertically adjustable reference component in place such that the vertical height of the vertically adjustable reference component 720 may be fixed. During different types of swings such as a full swing or a putting stroke, the vertical height of the vertically adjustable reference component 720 is preferably set to a desired position. Preferably, the locking mechanism 716 is a spring loaded lock, a tab in groove lock, or a tightenable fastener. In a preferred embodiment, the rotatable turret 712 includes a locking mechanism 717 that is operable to lock the vertically adjustable reference component 720 in place such that the horizontal position of the vertically adjustable reference component 720 may be fixed. Preferably, the locking mechanism 717 is a spring loaded lock, a tab in groove lock, or a tightenable fastener.

The vertically adjustable reference component 720 is preferably extendable such that the horizontal distance that an end portion of the vertically adjustable reference component 720 is from a golfer may be set. For example, the boom 725 is preferably a telescoping boom 725 having at least first and second sections wherein the second section can extend into and out of the first section. For example, the boom 725 preferably includes a first section 725*a*, a second section 725*b*, and a third section 725*c* wherein the third section 725*c* can telescope into the second section 725*b* and the second section 725*b* can telescope into the first section 725*a*, or vice versa. In a preferred arrangement, the first section 725*a* can telescope into the base 724. Preferably the first section 725*a*, the second section 725*b*, and/or the third section 725*c* include finger tabs 728 that aid a golfer in extending or retracting a respective section of the boom 725.

In an embodiment a first section of the telescoping boom 725 can be hollow and can include at least one groove in the interior thereof, and the second section of the telescoping boom 725 can include at least one rail on an exterior thereof. In this embodiment the rail of the second section fits in the groove of the first section such that the second section is aligned with the first section and the second section may be telescoped into and out of the first section. Preferably, the first section comprises two grooves in the interior thereof and the second section comprises two corresponding rails on the exterior thereof. The rails of the second section preferably provide a friction fit in the respective grooves such that second section can be telescoped within the first section to a predetermined position.

In an embodiment, the shin mountable golfing aid 700 can include a movable ball marker (not shown) that allows a golfer to mark the position of a golf ball. In an embodiment, the cross-bar 729 and/or a portion of the boom 725 can include a position indicator 761 to indicate a relationship between a foot or shin of a golfer and the position of a golf ball such that a golfer can consistently locate the ball at a proper position. In an embodiment, the position indicator 761 can include markings with predetermined angles, or alternatively the position indicator 761 can be a measurement device such as a ruler. In an additional embodiment, the cross-bar 729 can include a backswing rail (not shown) that is operable to limit the back swing of a golfer. The back swing rail is preferably adjustable, and more preferably removable from the cross-bar 729.

While the foot mountable golfing aid has been described in detail with reference to specific embodiments thereof, it will be apparent to those skilled in the art that various changes and modifications can be made, and equivalents employed, without departing from the scope of the appended claims.

What is claimed:

1. A foot mountable golfing aid operable to provide a reference path for a swing of a golfer, indicate a swing path, indicate a proper width of stance of a golfer, and/or aid in alignment of a body of the golfer in relation to a target when mounted on the foot of a golfer, the foot mountable golfing aid comprising:

a foot attachment component that is configured to be attached to a foot of a golfer; and a vertically adjustable reference component that is supported by the foot attachment component, the foot attachment component including a contoured plate configured to fit against an upper portion of a foot or shoe of a golfer.

2. The foot mountable golfing aid of claim 1, wherein the vertically adjustable reference component includes a first end portion pivotally attached to the foot attachment component and a second end portion outward of the first end portion such that the second end portion may be vertically adjusted by rotating the vertically adjustable reference component around the first end portion.

3. The foot mountable golfing aid of claim 1, wherein the foot attachment component further includes a shoe configured to receive the contoured plate such that the contoured plate is detachable from the shoe.

4. The foot mountable golfing aid of claim 1, wherein:

(a) an upper portion of the contoured plate of the foot attachment component includes a rotatable turret which supports the vertically adjustable reference component such that the vertically adjustable reference component may be horizontally rotated about the rotatable turret;

(b) the contoured plate is contoured for a right foot of a golfer or a left foot of a golfer;

(c) the contoured plate includes openings configured to receive straps that are operable to attach the foot mountable golfing aid to the foot of a golfer;

(d) the contoured plate includes one or more cut outs each extending between an upper and lower surface of the contoured plate, wherein the one or more cutouts are configured to increase the flexibility of the contoured plate; and/or (e) the contoured plate includes a pad on a lower surface thereof.

5. The foot mountable golfing aid of claim 4, wherein the upper portion of the contoured plate of the foot attachment component includes the rotatable turret and the rotatable turret includes a locking mechanism operable to lock the vertically adjustable reference component in place such that the horizontal position of the vertically adjustable reference component may be fixed.

6. The foot mountable golfing aid of claim 1, wherein the contoured plate is configured to fit against an upper portion of a foot of a golfer between the golfer's foot and a shoe that the golfer is wearing and:

(a) the contoured plate includes one or more supports extending downwardly therefrom; and/or (b) the contoured plate includes at least one rail that is configured to be received in a respective groove of the golfer's shoe.

7. The foot mountable golfing aid of claim 1, wherein the foot attachment component includes a locking mechanism operable to lock the vertically adjustable reference component in place such that the vertical height of the vertically adjustable reference component may be fixed.

8. The foot mountable golfing aid of claim 1, wherein the vertically adjustable reference component comprises a boom, the boom having a first end portion pivotally attached to the foot attachment component and a second end portion outward of the first end portion such that the second end portion may be vertically adjusted by rotating the vertically adjustable reference component around the first end.

9. The foot mountable golfing aid of claim 8, wherein;

(a) the boom is a telescoping boom having at least first and second sections;

(b) the boom includes a hinge along a length thereof such that the second end portion of the vertically adjustable reference component can be folded towards the first end portion of the vertically adjustable reference component;

(c) the boom includes a cross-bar at the second end portion thereof wherein the cross-bar is configured to provide a reference path for a swing of a golfer when the foot mountable golfing aid is attached to the foot of a golfer;

(d) the boom includes a laser wherein the laser is configured to provide a reference path for a swing of a golfer when the foot mountable golfing aid is attached to the foot of a golfer;

(e) the boom includes a level wherein the level is configured to indicate a slope of the ground;

(f) the boom includes a movable ball marker configured to mark the position of a golf ball;

(g) the boom includes a backswing rail at the second end portion thereof, the backswing rail operable to limit the back swing of a golfer;

(h) the boom includes a position indicator configured to indicate a relationship between a foot of a golfer and the position of a golf ball; and/or (i) the boom is a telescoping boom having at least first and second sections wherein at least one section includes a finger tab configured to aid a golfer in extending and retracting a respective section of the telescoping boom;

(j) the boom is a telescoping boom having at least first and second sections wherein the second section includes a cut out at an end thereof which is inserted into the first section, the cut out operable to provide a resilient friction fit in the interior of the first section such that the second section can be adjusted within the first section.

10. The foot mountable golfing aid of claim 1, wherein;

(a) the vertically adjustable reference component has at least first and second sections wherein the second section telescopes into the first section;

(b) the vertically adjustable reference component includes a hinge along a length thereof such that a second end portion of the vertically adjustable reference component can be folded towards a first end portion of the vertically adjustable reference component;

(c) the vertically adjustable reference component includes a cross-bar at an end portion thereof wherein the cross-bar is configured to provide a reference path for a swing of a golfer when the foot mountable golfing aid is attached to the foot of a golfer;

(d) the vertically adjustable reference component includes a laser wherein the laser is configured to provide a reference path for a swing of a golfer when the foot mountable golfing aid is attached to the foot of a golfer;

(e) the foot mountable golfing aid includes a level wherein the level is configured to indicate a slope of the ground;

(f) the foot mountable golfing aid includes a movable ball marker configured to mark the position of a golf ball;

(g) the vertically adjustable reference component includes a backswing rail, the backswing rail operable to limit the back swing of a golfer; and/or (h) the vertically adjustable reference component includes a position indicator configured to indicate a relationship between a foot of a golfer and the position of a golf ball.

11. The foot mountable golfing aid of claim 1, wherein;

(a) the foot attachment component includes a laser wherein the laser is configured to provide a reference path for a swing of a golfer when the foot mountable golfing aid is attached to the foot of a golfer;

(b) the foot attachment component includes a level wherein the level is configured to indicate a slope of the ground;

(c) the foot attachment component includes a movable ball marker configured to mark the position of a golf ball; and/or (d) the foot attachment component includes a position indicator configured to indicate a relationship between a foot of a golfer and the position of a golf ball.

12. The foot mountable golfing aid of claim 1, wherein the vertically adjustable reference component comprises a telescoping boom having at least first and second sections, wherein the first section is hollow and includes at least one groove in the interior thereof and the second section includes at least one rail on an exterior thereof, wherein the rail of the second section fits in the groove of the first section such that the second section is aligned with the first section and the second section may be telescoped into and out of the first section.

13. The foot mountable golfing aid of claim 12, wherein the first section comprises two grooves in the interior thereof and the second section comprises two corresponding rails on the exterior thereof, wherein the rails are configured to provide a friction fit in the respective grooves such that second section can be telescoped within the first section to a predetermined position.

14. The foot mountable golfing aid of claim 12, wherein the telescoping boom includes a third section, wherein the second section is hollow and includes at least one groove in the interior thereof and the third section includes at least one rail on an exterior thereof, wherein the rail of the third section fits in the groove of the second section such that the third section is aligned with the second section and the third section may be telescoped into and out of the second section.

15. The foot mountable golfing aid of claim 1, wherein the vertically adjustable reference component includes a boom having a first end portion and a second end portion the second end portion including a cross-bar extending substantially perpendicular to the length of the boom, wherein the cross-bar is integral with the boom or wherein the cross-bar may be attached to the end of the boom.

16. The foot mountable golfing aid of claim 1, wherein the first end portion is attached to the shoe via a rotatable turret such that the vertically adjustable reference component may be horizontally rotated.

17. The foot mountable golfing aid of claim 1, wherein the vertically adjustable reference component comprises a boom having a first end portion and a second end portion, the first end portion coupled to the foot attachment component, and the second end portion including a cross-bar extending substantially perpendicular to the length of the boom, wherein a cross-bar extension member is attached to a first end of the cross-bar and a cross-bar counterweight is attached to a second end of the cross-bar.

18. A shin mountable golfing aid operable to provide a reference path for a swing of a golfer, indicate a swing path, indicate a proper width of stance of a golfer, and/or aid in alignment of a body of the golfer in relation to a target when mounted on the shin of a golfer, the shin mountable golfing aid comprising:

a shin attachment component that is configured to be attached to a shin of a golfer;

and a vertically and/or horizontally adjustable reference component that is supported by the shin attachment component, the vertically and/or horizontally adjustable reference component extending between a first end portion adjacent the shin attachment component and a second end portion outward of the first end portion, the second end portion including a substantially perpendicularly extending cross-bar.

19. The shin mountable golfing aid of claim 18, wherein:

(a) the first end portion is attached to the shin attachment component at a horizontally rotating pivot such that the vertically and/or horizontally adjustable reference component is horizontally rotatable;

(b) the first end portion is attached to the shin attachment component at a vertically rotating pivot such that the vertically and/or horizontally adjustable reference component is vertically rotatable; or (c) the first end portion is attached to the shin attachment component at a vertically rotating pivot and a horizontally rotating pivot such that the vertically and/or horizontally adjustable reference component is vertically rotatable and horizontally rotatable.

20. A golf aid shoe operable to provide a reference path for a swing of a golfer, indicate a swing path, indicate a proper width of stance of a golfer, and/or aid in alignment of a body of the golfer in relation to a target when worn by a golfer, the golf aid shoe comprising:

a shoe configured to receive a foot of a golfer;

and a vertically adjustable reference component that is supported by the shoe, the vertically adjustable reference component extending between a first end portion adjacent the shoe and a second end portion outward of the first end portion, the second end portion including a substantially perpendicularly extending cross-bar.

* * * * *